United States Patent [19]

Giorgetti

[11] 4,455,475

[45] Jun. 19, 1984

[54] AUTOMATIC DEVICE FOR QUICK HEATING OF LIQUIDS, PARTICULARLY WATER

[75] Inventor: Aldo Giorgetti, Rome, Italy

[73] Assignee: Pier Francesco Talenti, Potomac, Md.

[21] Appl. No.: 405,130

[22] Filed: Aug. 4, 1982

[30] Foreign Application Priority Data

Sep. 14, 1981 [IT] Italy ..... 49287 A/81

[51] Int. Cl.[3] ..... H05B 3/78; F24H 1/10

[52] U.S. Cl. ..... 219/306; 219/309; 219/314; 219/333; 219/282

[58] Field of Search ..... 219/306, 307, 282, 298, 219/309, 314, 320, 333, 308, 321; 137/341; 122/13 A, 4 A; 165/101

[56] References Cited

U.S. PATENT DOCUMENTS 1,069,374 8/1913 Bell ..... 219/302

*Primary Examiner*—B. A. Reynolds
*Assistant Examiner*—Teresa J. Walberg
*Attorney, Agent, or Firm*—Beveridge, DeGrandi & Kline

[57] ABSTRACT

The invention relates to an automatic device for quick heating of liquids, particularly water, which device includes at least two containers having conduits for supplying cold water and provided each with heating means, a tank into which warm water is alternatively supplied from outlets of the single containers, first control means for alternatively actuating said outlets, second control means sensitive to the pressure within said tank for connecting or disconnecting said heating means and third control means sensitive to the depression within one of said containers for disengaging said heating means and said first control means of the outlets.

7 Claims, 4 Drawing Figures

AUTOMATIC DEVICE FOR QUICK HEATING OF LIQUIDS, PARTICULARLY WATER

The present invention refers to an automatic device for quick heating of liquids, particularly water.

From about ten years there has already been known heating devices, such as electric water heaters, in which the water is heated by an electric heating element arranged within the heater.

As is known, the electric water heaters presently used, contain a certain amount of water (usually 80 or 100 l), the heating of which requires 6 to 9 hours to go from room temperature to a temperature of 50°-60° C. This long time is a great drawback in case of the necessity of instantaneous disposing of the heated water. Otherwise the device should be continuously maintained in operation thereby requiring a high amount of energy.

Moreover, the necessity of heating a quantity of water which is remarkably greater than that required, causes a further useless energy loss.

There should be also taken in consideration the thermal losses of the water storage heater by conduction and convection, which losses cause a further increase in the energy consumption and thus of the actuation costs.

All these losses result in a heavy economic disadvantage, particularly in the present energy crisis caused by a continuous increase of the cost of electric power.

There are also known instantaneous water heaters which require, however, a large amount of power (of about 3 kw) and supply less than 1l/min of water at a temperature of about 35°-40° C.

It is thus the purpose of the present invention to provide an automatic device for heating of water which avoids or at least greatly reduces the drawbacks of the known water heaters.

This purpose is attained by providing an automatic device for quick heating of liquids, particularly water, which device consists of:

at least two containers having supply conduits for cold water and provided each with a heating element;

a tank into which the heated water is alternatively supplied from outlets of said containers;

first control means for alternatively actuating said outlets;

second control means sensitive to the pressure within said tank for connecting or disconnecting the heating means and third control means sensitive to the pressure within said containers for disengaging said heating means and said first control means of the outlets.

The control means for the outlets of the single containers are arranged so as to alternatively supply into the tank a quantity of the hot liquid corresponding to the volume of one container divided by the number of the containers, so that the quantity of water flowing into the tank at any complete cycle will be never greater than the volume of a single container.

The invention will be now disclosed with reference to the enclosed drawing showing, by way of an example an embodiment relating to a water heater, it being however understood that the device may be used for a quick and economic delivery of any hot liquid.

Figure 1:
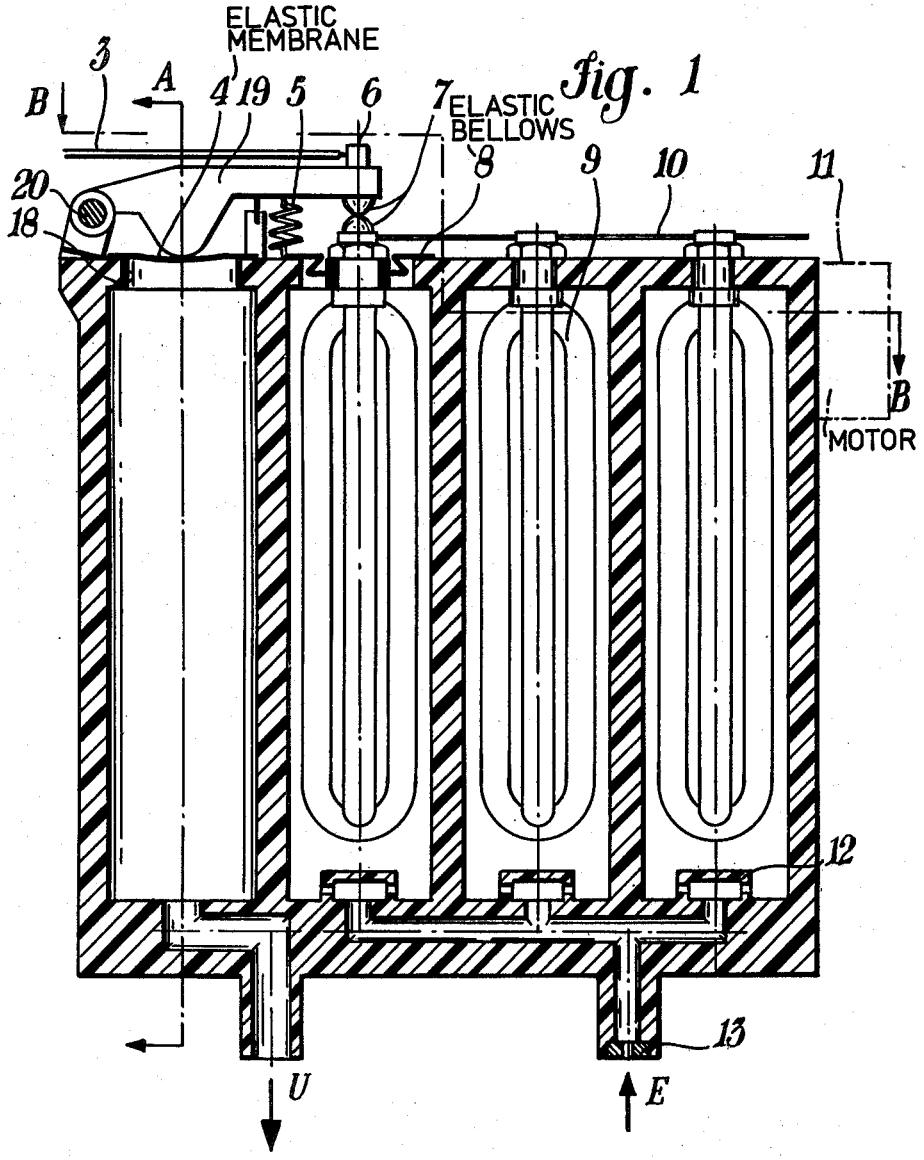
FIG. 1 shows a vertical section view of the water heater of the invention having three heating containers and a tank adapted to be connected with said container for delivery of hot water.
Figure 2:
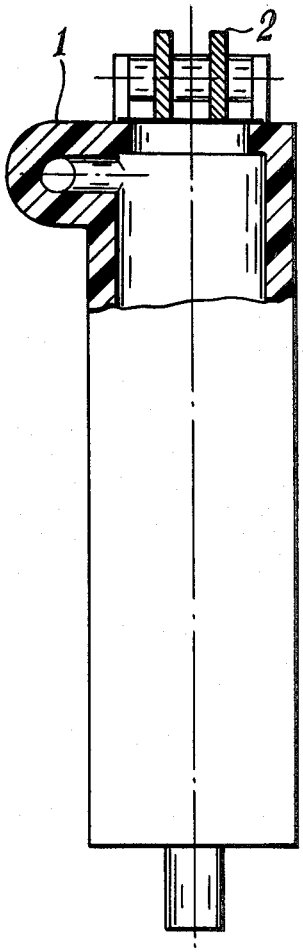
FIG. 2 is a section view along the line A—A in FIG. 1.
Figure 4:
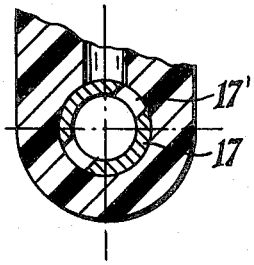
FIG. 4 is a cross section view of a control shaft for supplying the water from the single container to the tank.
Figure 3:
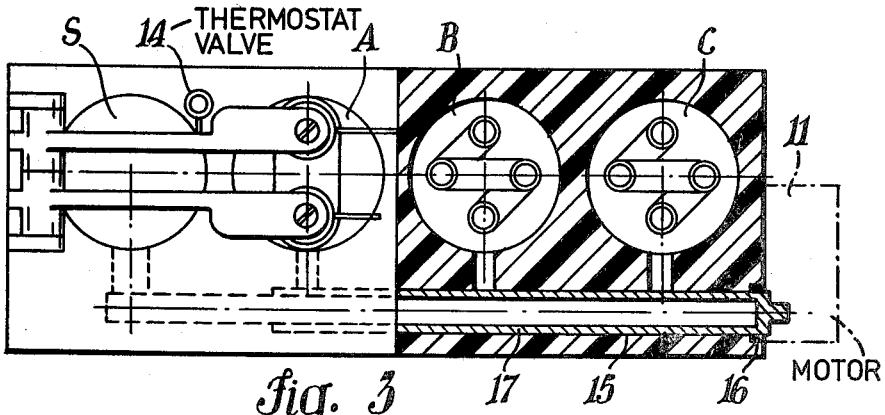
FIG. 3 shows a top view, partly in section along the line B—B of FIG. 1.

As it is shown in the figures, particularly in FIG. 1, the automatic water heater according to the invention consists of a series of single containers. In the embodiment, shown as an illustrative example in the drawing, there are provided three containers indicated in the figures with the reference letters A, B and C, (see FIG. 3) but it is understood that the number thereof depends on the requirements of a given plant which should be supplied with hot water. Therefore, in a plant provided, for example, with a plurality of shower-baths the number of the containers will be proportionally increased.

In each of said containers there is provided an electric heating element 9. The water is supplied into the containers simultaneously through an inlet duct E provided with a flow control valve 13.

In the upper portion of the containers A, B and C a single outlet conduit 15 is provided, through which the hot water delivered from the single containers is supplied into a tank S connected to the hot water duct by an outflow U provided at its lower portion.

The tank S has at its top wall an aperture 18 closed by an elastic membrane 4. Over this membrane there are arranged two lever arms 19 pivoted at their one end on a trunnion 20 provided at the rim of the tank S.

These lever arms 19 have each a pawl 2 which abuts on said elastic membrane 4.

The other end of the lever arms 19 is provided with an electric contact 7, to which the electric current is delivered through a wire 3.

The contact 7 abuts on a contact 7 which delivers the electric current to a heating element 9 of the container A. The heating elements 9 of the remaining containers are connected to that of the container A through electric connections 10. In an intermediate point between the pawls 2 and the contacts 7 each lever arm 19 is stressed downwards into the contact position with the heating elements 9 by means of a return spring 5.

Beside this return spring 5, a thermostat valve 14 is provided for lifting the lever arms 19 and, thus, for interrupting the electric contact when for any reason the water temperature exceeds the established one.

The hot water is suppled into the tank S from the containers A,B,C through said outlet duct 15 provided in the upper portion of the housing of the heater. Within the outlet duct 15 a rotary shaft 17 is arranged, by interposition of a gasket 16, which shaft has openings 17' provided in coincidence with the outlet holes of the single containers and offset from one another at an angle of 60° in case of three containers of the embodiment shown in the drawing.

The rotary movement of the shaft 17 is obtained by means of a small electric motor 11, which is supplied with electric current through the wires 10 conducting the current to the heating elements of the containers B and C. The operation of the water heater according to the invention is as follows.

The opening of a hot water cock causes a depression in the tank S which depression deflects the elastic membrane 4 on which the powls abut, so that the return springs 5 urge the lever arms 19 toward the contact position of the contacts 7, which permits the electric current to flow to both the heating elements 9 of the container A,B and C and motor 11, which puts in rotation the rotary shaft 11 and, thus, permits alternating delivery of the water to the hot water tank S from the containers A, B and C.

The closure of the hot water cock increases the pressure in the tank S, the elastic membrane 4 deflects upwardly, disconnects the contacts 7 and puts the entire heater out of operation.

Should the water level fall, a depression forms in the tank S and also in the containers A, B and C. For avoiding in such an event the delivery of electric current to both the heating elements 9 and motor 11, the heating element is mounted in an elastic bellows 8, for example of rubber, which lowers when the pressure decreases an extent sufficient to disconnect the electric connection of the contacts 7.

In a preferred embodiment, the containers A, B, C and the tank S form a unique body of plastics having a high mechanical strength and withstanding temperatures over 150° C. This body of the water heater in contained in a sturdy outer protection housing.

The overall dimensions of the entire heater are smaller than those of the conventional heaters and have the advantage of a flat shape which readily fits to the wall on which it is to be mounted.

Obviously, the distance between the inlet duct (E) for the cold water and the outlet duct (U) for the hot water corresponds to the standardized distance of the already existing ducts, so that the mounting of the water heater does not require any modification of such ducts.

The heater according to the above disclosed embodiment, built from plastics and having a flow of 4 to 5 l/min of 50°–60° C. hot water, requires a total power of 1.5–1.8 KW, has overall dimensions of 30×30×10 cm and a weight of about 6 Kg. At the present price of the electric power the cost of 1 liter of hot water heated to the above said temperature is about 0.50 Italian lira and thus a cost which is remarkably lower than that (8–10 Italian liras for one liter) of conventional heaters.

In the above disclosed embodiment, as a means for alternatingly controlling the outflow of hot liquids there has been adopted a system consisting of both the small electric motor and rotary shaft for supplying the hot water to the tank. However, one skilled in the art would have no difficulty to replace this system for example by valves actuated so as to alternatively open and close the outlet apertures of the containers, which containers obviously could be placed not only in a linear arrangement, but in any other geometrical configuration, such as circular, rectangular, triangular etc.

It would be also understood that the connecting and disconnecting means of the heating elements may be replaced by other systems which are sensitive to the pressure in the tank and in one of the containers.

Thus, the present invention has been disclosed with reference to a preferred embodiment thereof, but it is understood that several modifications may be made therein without departing from the protection scope of the present invention.

I claim:

1. Automatic device for quick heating of liquids, comprising at least two containers having at their lower portion ducts for introducing cold liquid and each container being provided with heating means and outlet means; a tank into which hot liquid is alternatingly supplied from said outlet means of the said containers; control means for actuating said outlets of said containers; means sensitive to the pressure in said tank for connecting or disconnecting said heating means and said control means; and means sensitive to the level of liquid in one of the containers for disconnecting said heating means and said control means of the outlets.

2. Device according to claim 1, further comprising heating means consisting of electric resistors.

3. Device according to claims 1 or 2, further comprising means sensitive to the pressure in the tank in the form of a lever arm pivoted at its one end on said tank and having at its other end two contacts connected to an electric current source and adapted to come in contact with two contact elements of the heating resistor of an adjacent container and a pawl downwardly projecting at an intermediate portion of said arm and abutting on an elastic element sensitive to the pressure in said tank, said arm being urged by a return spring towards the position of electric contact with said contact elements, the heating resistor of the container adjacent to the tank being electrically connected with both the heating resistors of the subsequent containers and said control means of the outlets of the single containers.

4. Device according to claim 3, further comprising said means sensitive to the pressure in the tank in the form of an elastic membrane arranged on the tank top, which membrane deflects in the case of a depression in the tank due to the aperture of a hot water cock, so that the return spring urges the contact of the lever arm into the contact position with the contact elements of the heating resistor of the adjacent container.

5. Device according to claim 3, further comprising said control means of the container outlets in the form of a small electric motor and a rotary shaft actuated by said motor and arranged in coincidence with the container outlets, by interposition of gaskets, said shaft being provided with a plurality of holes the number of which corresponding to the number of said outlets, said holes being offset from one another at an angle of 180°:n, n being the number of containers, so that when the hollow shaft rotates the hot water enters said tank through the holes of said shaft in an alternating manner.

6. Device according to claim 3, further comprising said means sensitive to the pressure in one of the containers in the form of an elastic bellows in which the heating resistor is arranged, so that in the case of a depression in said container the bellows lowers causing the disconnection of the heating resistors.

7. Device according claim 1, further comprising a thermostat valve provided for disconnecting said heating means when liquid is heated to an excessive temperature.

* * * * *